US010744624B2

(12) United States Patent
Simmonds

(10) Patent No.: US 10,744,624 B2
(45) Date of Patent: Aug. 18, 2020

(54) ROTATIONAL DRIVER

(71) Applicant: REDBACK PNEUMATICS PTY LTD, Victoria (AU)

(72) Inventor: Brian Simmonds, Victoria (AU)

(73) Assignee: REDBACK PNEUMATICS PTY LTD, Victoria (AU)

( * ) Notice: Subject to any disclaimer, the term of this patent is extended or adjusted under 35 U.S.C. 154(b) by 14 days.

(21) Appl. No.: 15/753,040

(22) PCT Filed: Aug. 8, 2016

(86) PCT No.: PCT/AU2016/000272

§ 371 (c)(1),
(2) Date: Feb. 15, 2018

(87) PCT Pub. No.: WO2017/031519

PCT Pub. Date: Mar. 2, 2017

(65) Prior Publication Data

US 2018/0193988 A1 Jul. 12, 2018

(30) Foreign Application Priority Data

Aug. 26, 2015 (AU) ..... 2015218456

(51) Int. Cl.
*B25B 23/00* (2006.01)
*B25B 21/00* (2006.01)
*B25F 5/00* (2006.01)

(52) U.S. Cl.
CPC ..... *B25B 23/0078* (2013.01); *B25B 21/00* (2013.01); *B25B 23/0007* (2013.01); *B25F 5/001* (2013.01)

(58) Field of Classification Search
CPC . B25B 21/00; B25B 23/0078; B25B 23/0007; B25F 5/001
USPC ..... 81/57.13
See application file for complete search history.

(56) References Cited

U.S. PATENT DOCUMENTS 1,762,515 A * 6/1930 Hiersch ..... B25B 17/00 81/57.31
4,171,651 A * 10/1979 Dacunto ..... B25B 21/00 81/57.29
4,462,282 A * 7/1984 Biek ..... B25B 21/00 173/181
5,203,238 A * 4/1993 Ferguson ..... B25B 21/005 81/57.39
5,429,017 A * 7/1995 Junkers ..... B25B 21/004 81/57.4
5,513,546 A * 5/1996 Ikeda ..... B25B 21/00 74/378

(Continued)

OTHER PUBLICATIONS

Official Communication issued in International Pat. Appl. No. PCT/AU2016/000272, dated Sep. 12, 2016.

*Primary Examiner* — Hadi Shakeri
(74) *Attorney, Agent, or Firm* — Greenblum & Bernstein, P.L.C.

(57) ABSTRACT

A device, for rotationally driving an element, including a rotationally-driven member at a front of the device and engageable with, to transmit rotational drive to, the element. A formation is shaped to contact, to transmit a reaction torque to, an attachment. A rearward-facing portion is at the rear, or rearward, of the formation. An arrangement engages, to act between, the rearward-facing portion and the attachment to rearwardly urge the attachment.

10 Claims, 4 Drawing Sheets

(56) References Cited

U.S. PATENT DOCUMENTS

| | | | | |
|---|---|---|---|---|
| 6,152,243 | A | 11/2000 | Junkers | |
| 6,619,159 | B2 * | 9/2003 | Galat | B25B 21/00 81/57.13 |
| 9,016,173 | B1 | 4/2015 | Saftoiu | |
| 9,056,390 | B2 | 6/2015 | Hellstrom | |
| 2008/0127425 | A1 * | 6/2008 | Chen | B29C 73/06 7/100 |
| 2013/0104702 | A1 | 5/2013 | Hellstrom | |
| 2015/0107419 | A1 | 4/2015 | Saftoiu | |
| 2015/0107421 | A1 | 4/2015 | Saftoiu | |
| 2015/0111692 | A1 | 4/2015 | Saftoiu | |
| 2015/0231772 | A1 | 8/2015 | Saftoiu | |

* cited by examiner

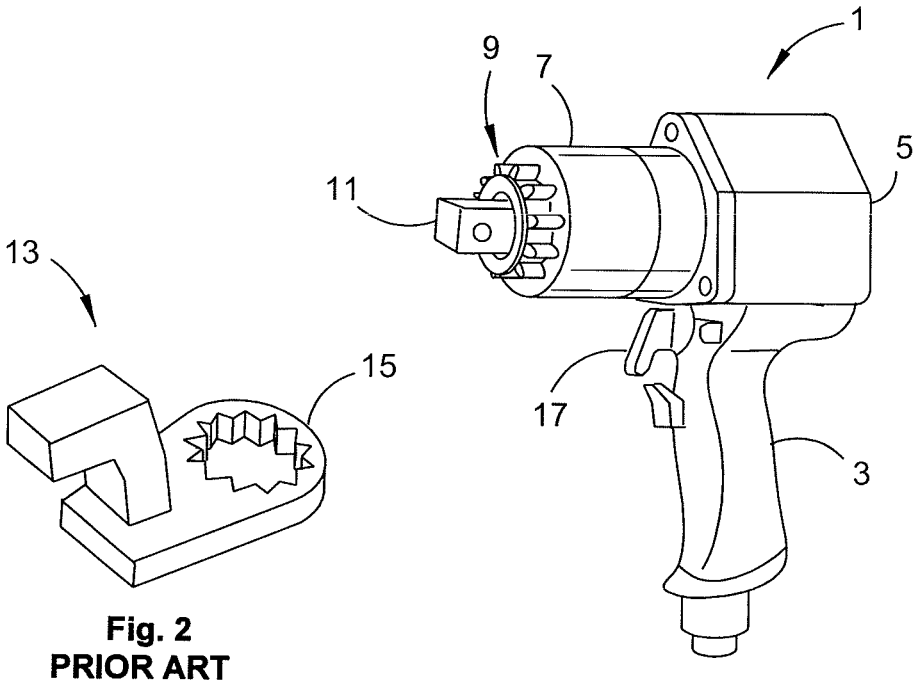
Fig. 2
PRIOR ART
Fig. 1
PRIOR ART
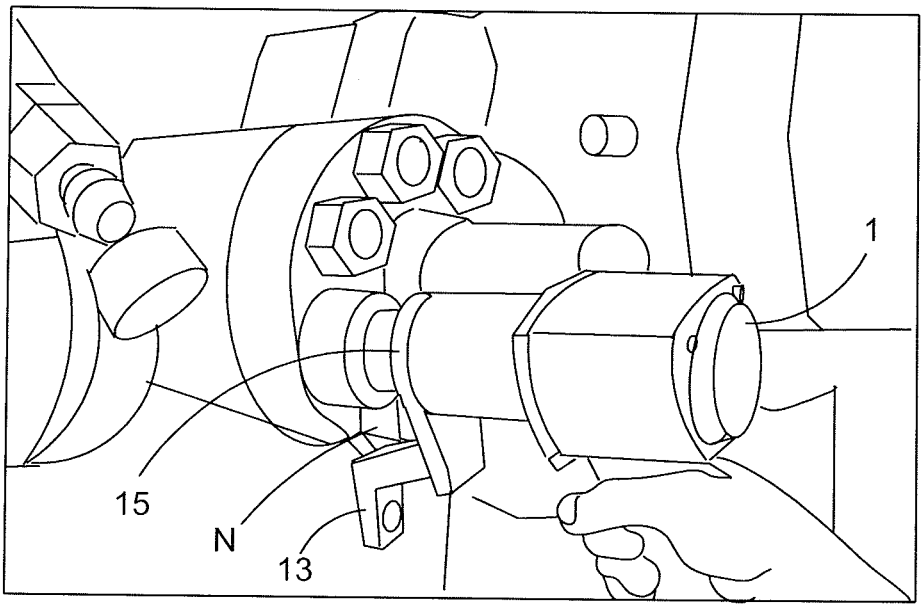
Fig. 3
PRIOR ART

ROTATIONAL DRIVER

FIELD

The invention relates to rotational drive tools and to attachments therefor.

BACKGROUND

Rotational drive tools of the type illustrated in FIG. 1 are often referred to as 'nutrunners', 'torque wrenches' or 'torque guns', etc. Such tools are used in industry for tightening nuts and bolts and other similar tasks.

The tool 1 includes a handle 3 integrally moulded with a housing 5 housing a motor. A gearbox 7 is at least axially fixed to the front of the housing 5. An externally-splined tubular boss 9 forwardly projects from the gearbox 7 and a square-profiled drive member 11 projects forwardly from the boss 9. The axially-splined exterior of the boss 9 is fixed relative to the exterior of the gearbox 7 and the housing 5 and is often referred to as a serpentine.

A wide variety of attachments have been developed for this style of rotational driver, such as the reaction arm 13. The reaction arm 13 includes a portion 15 shaped to embrace and engage the serpentine of the boss 9 so that the reaction arm is restrained from rotation about the axis of the gearbox 7. Reaction arms are often axially restrained relative to the gearbox 7 via a grub screw passing axially through the serpentine-embracing portion 15 of the arm.

FIG. 3 shows the use of such a tool to tighten a nut. For this purpose, the reaction arm 13 and a socket 15 are fitted to the tool 1. The socket 15 includes a rearwardly-open square-profiled bore dimensioned to receive and be driven by the member 11, and also a forwardly-open hexagonal-profiled bore to receive and rotationally drive a nut. The assembled tool, attachment and socket set 1, 13, 15 is engaged with a nut to be tightened so that the arm 13 engages a feature fixed relative to the axis of the nut to be tightened, so that the body of the gearbox does not rotate when torque is applied to the nut. In the example of FIG. 3, the arm 13 engages an adjacent nut N.

A trigger 17 of the tool 1 is squeezable to actuate the motor to produce a rotational drive. The motor may be, for example, a mains-electric motor, a battery-electric motor, a hydraulic motor or a pneumatic motor. The gearbox receives the rotational drive from the motor and in turn rotationally drives the socket 15 via the member 11. The socket 15 in turn drives the nut.

In some applications, it is not possible or convenient to move the tool 1 into close proximity to a nut that is to be tightened. For this purpose, a variety of extension pieces have been developed. FIG. 5 illustrates an extension piece 19 including a reaction arm welded to an outer body of the extension piece. The outer body of the extension piece fits over the forward end of the tool and mates with the serpentine of the boss 9. An inner body of the extension piece is journalled to rotate within the outer body to transmit shaft power from the member 11 to a similar drive-transmitting member 11' at the forward end of the extension 19.

FIG. 6 illustrates another extension piece 21, the outer body of which has a serpentine at its forward end, to which a reaction arm 13' is mounted. A socket 15' is also attached at the forward end of the extension 21. In other applications, it is not possible or convenient to coaxially align tool 1 and a nut that is to be tightened. For this purpose, various offset tools, similar to the offset tool 23 of FIG. 7, have been developed. FIG. 7 shows a gearbox 25 coupled with the offset tool 23. The offset tool 23 serves to laterally transmit rotational drive from the gearbox 25 to a hex socket 27. The axis of hex socket 27 is laterally displaced from the axis of the gearbox.

Extension pieces and offset tools and other attachments have conventionally been attached with the aid of a radially-oriented grub screw engaging the serpentine of the tool 1 as described in respect of the reaction arm 13. The present inventor has recognised that this long-accepted mode of engagement is less than entirely reliable. From time to time, various attachments have fallen off tools. This can be very dangerous. Attachments such as extension pieces 19, 21 are heavy. A falling extension piece could injure the worker operating the tool or, worse still, potentially fatally injure a worker at a lower level of a construction site. In other instances, reaction arms have axially slipped the serpentine during operation. This slippage, in the context of tools having a gearbox housing fully fixed relative to the handle, suddenly and without warning exposes the operator to the torque of the tool. This can result in strain and crushing injuries.

In various applications, it is important to know the torque applied to a driven element such as a nut. For this purpose, rotational drive tools typically incorporate some means by which the applied torque is controlled. This may entail sensors arranged to sense the torque transmitted via the member 11, or to sense feedback from the motor unit. The present inventor has also recognised that the conventional mode of attaching a reaction arm typically involves some degree of play between the arm and the tool, that this play can lead to misalignment between the axis of the tool and the nut (or other driven member), and that this misalignment can result in the tool applying about 15% less than the desired torque to the nut.

Instead of the grub screw, some rotational drivers incorporate circlips sitting in front of the serpentine. Circlips are considered fiddly and inconvenient, and relative to the use of grub screws offer no improvement in terms of alignment. Attaching a circlips in this way also offers a less than entirely reliable means of attachment. It is easy to inadvertently misalign a circlip so that it does not seat within its groove properly. Moreover, the inventor has observed that the mentioned misalignment can cause even a correctly installed circlip to conically deform and forwardly escape its groove. Of course, such circlip arrangements are incompatible with many attachments such as the extensions 19, 21.

It is not admitted that any of the information in this patent specification is common general knowledge, or that the person skilled in the art could be reasonably expected to ascertain or understand it, regard it as relevant or combine it in any way before the priority date.

SUMMARY

One aspect of the invention provides a device, for rotationally driving an element, including a rotationally-driven member at a front of the device and engageable with, to transmit rotational drive to, the element;

a formation shaped to contact, to transmit a reaction torque to, an attachment;

a rearward-facing portion at the rear, or rearward, of the formation; and an arrangement for engaging, to act between, the rearward-facing portion and the attachment to rearwardly urge the attachment.

The arrangement preferably includes a threaded element of one of the device and the attachment and co-operable with a thread on the other of the device and the attachment. Most preferably, the device includes the threaded element. Optionally, the threaded element is rotatable relative to the formation.

Another aspect of the invention provides a device, for rotationally driving an element, including a rotationally-driven transmission member at a front of the device and engageable with, to transmit rotational drive to, the element;

a formation shaped to contact, to transmit a reaction torque to, an attachment;

a threaded element rotatable relative to the formation to co-operate with a thread of the attachment to rearwardly urge the attachment.

According to either aspect, the threaded element is preferably a captured threaded element. It may be a collar.

The device may include a rib formation running about the device and upon which the threaded element acts. The rib formation preferably runs about a housing which houses outward-force generating components of the device to resist outward deformation of the housing. The rib formation may be a continuous rib encircling the device.

The formation shaped to contact the attachment is preferable a serpentine.

The device may be a gearbox, and another aspect of the invention provides a device including a motor coupled to such a gearbox.

The device may be a tool including a motor.

Another aspect of the invention provides an attachment, co-operable with the device, including a thread co-operable with the threaded element of the device to rearwardly urge the attachment. The attachment may be a reaction arm, extension piece or offset tool.

Another aspect of the invention provides a set including the device and the attachment.

Another aspect of the invention provides a set including a tool for rotationally driving an element;

an attachment for the tool; and an arrangement;

the tool including

- a rotationally-driven member at a front of the device and engageable with, to transmit rotational drive to, the element;
- a formation shaped to contact, to transmit a reaction torque to, an attachment;

the arrangement being configured to rearwardly urge the attachment whilst a front of the arrangement is rearward of, or aligned with, a front of a forward-most point of contact between the formation and the attachment.

Preferably, the arrangement is configured to so rearwardly urge the attachment whilst a front of the arrangement is rearward of, or aligned with, a rear of a rear-most point of contact between the formation and the attachment.

BRIEF DESCRIPTION OF DRAWINGS

FIG. 1 is a perspective view of a tool.

FIG. 2 is a perspective view of a reaction arm.

FIG. 3 is a perspective view of the tool of FIG. 1 in use.

DESCRIPTION OF EMBODIMENTS

The following examples are intended to illustrate the scope of the invention and to enable reproduction and comparison. They are not intended to limit the scope of the disclosure in any way.

Figure 4:
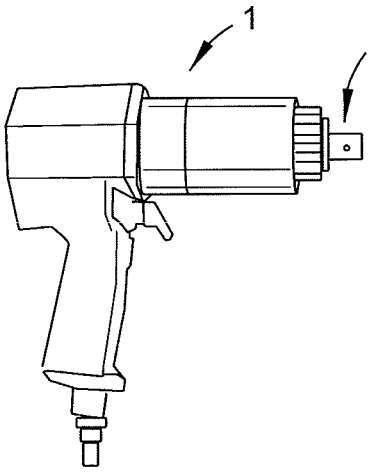
Fig. 4 PRIOR ART
FIG. 4 is a side view of the tool of FIG. 1.
Figure 5:
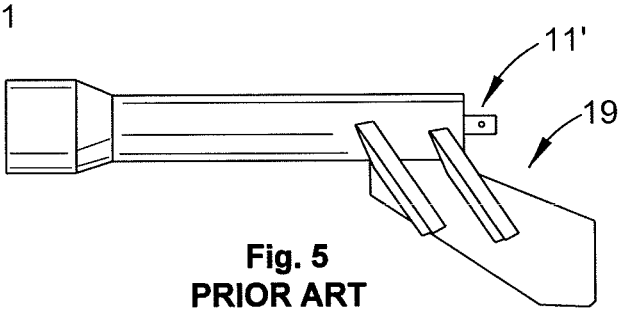
Fig. 5 PRIOR ART
FIG. 5 is a side view of an extension piece.
Figure 6:
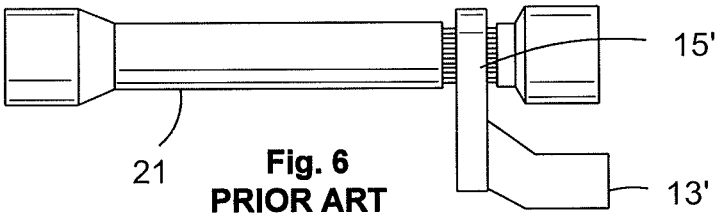
Fig. 6 PRIOR ART
FIG. 6 is a side view of another extension piece fitted with a reaction arm and a socket.
Figure 7:
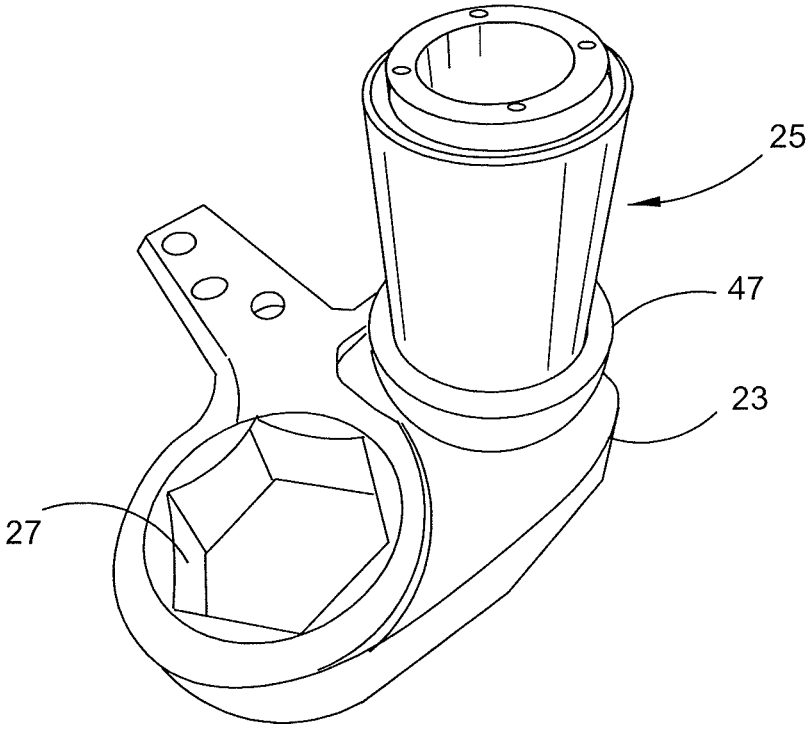
FIG. 7 is a perspective view of a gearbox fitted to an offset attachment.
Figure 8:
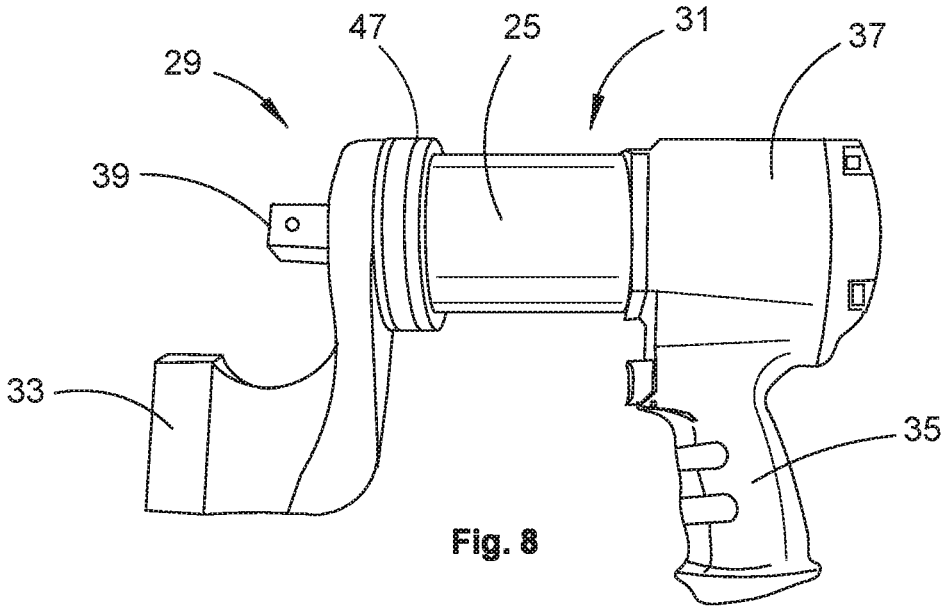
FIG. 8 is a side view of a tool 1 including the gearbox shown in FIG. 7 and a reaction arm.

FIG. 8 shows a set 29 including a tool 31 and an attachment 33 in the form of a reaction arm. The tool 31 includes a handle 35. Optionally, as illustrated, the handle is integrally formed with a housing 37 in which a motor is housed. The gearbox 25 is mounted to the front of the housing 37 to receive rotational drive from the motor. A square-profiled member 39 projects from the forward end of the gearbox 25 to rotationally drive an element such as the socket 15.

The gearbox 25 includes a housing 41 which presents a cylindrical exterior. The housing 41 is at least axially fixed relative to the housing 37. A tubular boss 43 projects forwardly from the forward end of the housing 41. An exterior of the boss 43 defines a serpentine.

The housing 41 houses an arrangement of gears which transmit drive from the motor to the member 39. The gears define a reduction ratio whereby the member 39 operates at a lower speed but higher torque than the motor produces. The arrangement of gears is omitted from FIG. 10 for clarity.

A square-profiled rib 44 concentrically encircles a forward end of the housing 41's cylindrical exterior. The rib 44 serves two purposes. Firstly, it radially reinforces the housing 41 to resist deformation resultant from the action of the internally-carried gear mechanism. Secondly, the rib 44 defines a rearward-facing annular surface 45 which provides an anchor point against which the attachment 33 can be rearwardly drawn to more securely and accurately align the attachment 33 relative to the tool 31. In this example, the rib 44 is integral to the housing 44, although optionally the rib (or another anchor arrangement) could be one or more attached pieces.

A collar 47 is fitted to the gearbox. The collar 47 includes a cylindrical wall dimensioned to slide over the cylindrical exterior of the rib 44. The rear end of the collar 47 includes a short, inwardly-projecting flange dimensioned so that it cannot pass over the rib 44 to limit forward movement of the collar 47. The front of the collar 47 sits forward of the rib 44 and is internally threaded.

The attachment 33 includes a serpentine-engaging portion 51 shaped to encircle and engage the serpentine of the boss 43. An externally-threaded ring 53 projects rearwardly from the serpentine-engaging portion 51. To fit the attachment 33 to the tool 31, the portion 51 is placed over member 39 and boss 43 so that the portion 51 engages the boss 43 to rotationally fix the attachment 33 relative to the housing 41 and to the tool 31 more generally. With further rearward movement of the attachment 33, and potentially also forward movement of the collar 47, the threads of the portion 51 are moved into engagement with the threads of the collar 47. The collar 47 may then be rotated about the axis of the tool 31 (i.e. relative to the rotationally-fixed ring 53) to tighten that engagement.

Figure 10:
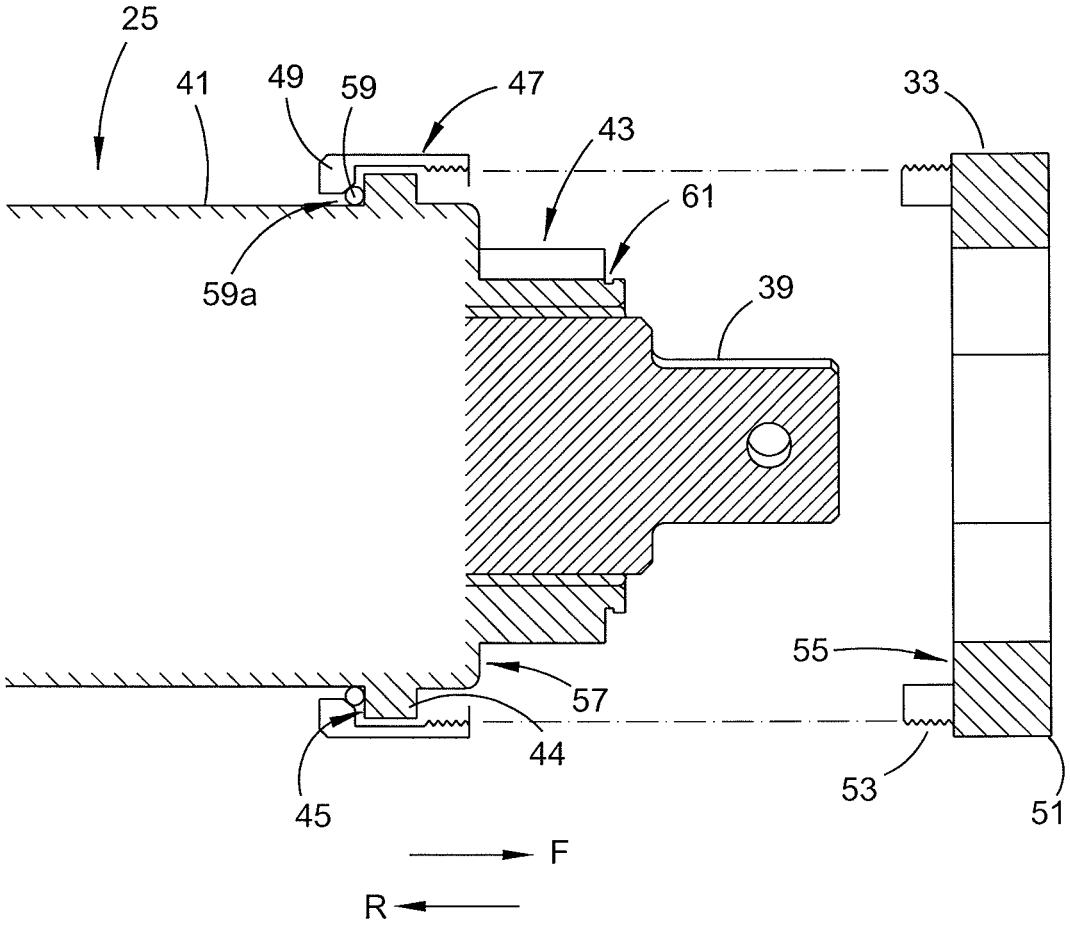
FIG. 10 is an axial cross-section view of a forward end of the tool, and the reaction arm, shown in FIG. 8.

With ongoing tightening of the collar 47, the attachment 33 is rearwardly urged until a rearward face 55 of the portion 51 is brought into engagement with a forward-facing portion 57 of the tool. In this example, the forward-facing portion 57 is a planar face, at the front of the gearbox, encircling the formation 53. For the avoidance of doubt, the arrows F and R in FIG. 10 illustrate the forward and rearward directions respectively as those terms, and similar terms, are used herein.

The collar 47 thus constitutes an arrangement for rearwardly urging the attachment 33 so that the face 55 is clamped against the face 57.

The mutual engagement of the faces 55, 57 provides for a more accurate alignment between the axes of the attachment 33 and the tool 31, which in turn leads to torque being more accurately applied. Whilst the contacting surfaces 55, 57 are simple planar surfaces in this example, other attachment-aligning contact configurations are possible.

In this example, the collar 47 is an integrally-formed metallic component and a resilient element, in the form of O-ring 59, is captured between the flange 49 and the rib 44. The O-ring 59 provides a degree of resilience whereby the collar 47 can be conveniently hand tightened, yet the attachment 33 remains securely and reliably retained. Other forms of resilient element may be incorporated within the clamping arrangement and yet other clamping arrangements may have no resilient element at all.

In operation, the flange 49 engages the rearward-facing portion 59*a* of the O-ring 59 and the collar 47 engages the ring 53. The collar acts between that rearward-facing portion 59*a* and the ring 53 to rearwardly urge the attachment 33 to clamp the portions 55, 57 against each other. The O-ring 59 is axially supported by the rib 44 in this example. Other forms of axial support are possible.

The collar 47 is at the rear of the attachment 33. By locating the collar in this region, the described means of attachment is compatible with a wide range of attachments including attachments similar to attachments 19, 21 and 23. Moreover, the threaded engagement provides for a simple yet secure and reliable means of attachment. In particular, the collar 47 provides for convenient tool-less operation.

The rib 44 serves to prevent the collar 47 from being forwardly released from the cylindrical exterior of the gearbox 25. The housing 37 likewise projects outwardly beyond the cylindrical exterior of the gearbox 25 whereby the collar 47 is captured on the gearbox.

Figure 9:
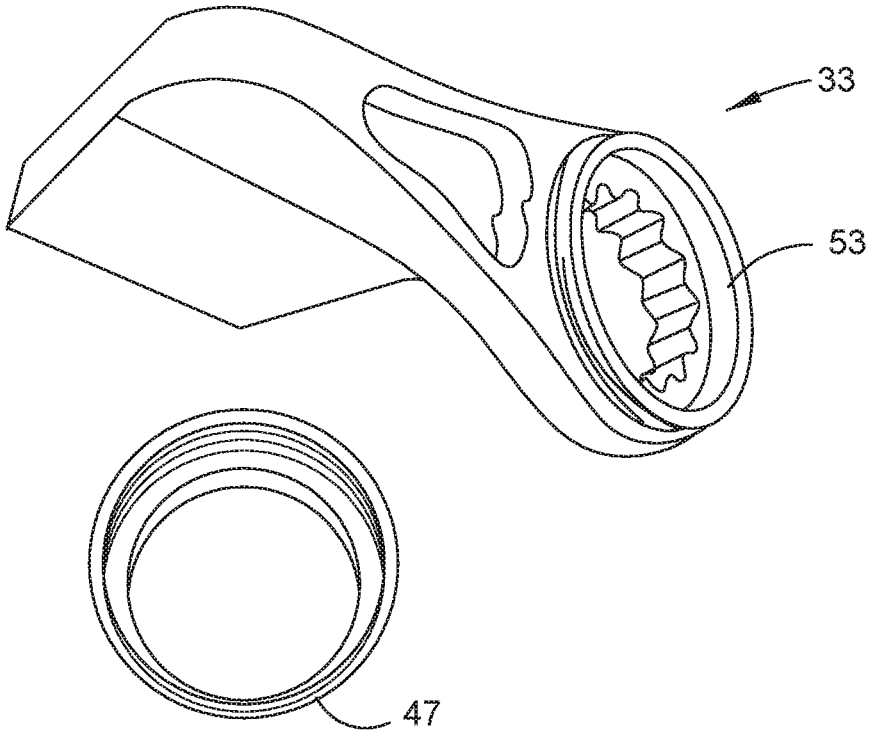
FIG. 9 is a perspective view of the reaction arm, and a locking collar, shown in FIG. 8.

It will be appreciated that the described arrangement is a very significant advance over the described prior art arrangements. Many variations over the example of FIGS. 8 to 10 are possible and would be advantageous over the described prior art. The invention is not limited to this described example. Rather, it is defined by the claims.

The threading engagement between the tool 1 and the attachment 33 offers advantages in and of itself. Indeed, simply extending the rib 44 so that a screw may be passed axially therethrough to engage a suitable threaded bore within the attachment 33 would be an advance over the prior art arrangements.

On the other hand, other advantageous variants do without threaded portions. By way of example, the collar 47 might be replaced by a lever lock ring to engage the rib 44 and a complementary rib formed at the rear of the attachment 33 so as to mutually clamp those ribs in a manner akin to the closures often applied to large paint cans.

The tool 31 carries the collar 47, although it is also possible that the collar might be carried by the attachment 33.

The portion 59*a* is rearward of the serpentine-defining boss 43, although potentially the rib 44 could be moved forward to sit on an annular extension of the cylindrical wall of the housing 41. This might entail the tool 33 being formed with a tubular boss shaped to fit within this wall and to engage the serpentine.

Likewise, it would of course be *trite* to swap the male and female threads between the collar 47 and the ring 53. This might entail enlarging the ring 33 to sit over the collar.

Whilst the reaction torque-transmitting feature takes the form of the serpentine about the exterior of the boss 43, other formations are possible. By way of example, this formation might take the form of a square-profiled bore into which a square-profiled tubular boss of the attachment is receivable. Likewise, the member 39 may itself be a socket for rotationally driving an element.

Not all variants of the device entail a gearbox. For example, a suitable motor might be mounted inside the housing 41 and directly drive the member 39.

In this example, the portion 59*a* is part of the toroidal exterior of the O-ring. Other forms of rearward-facing portion are possible, e.g. the rearward-facing portion might be a portion of a helical face within a thread.

An outwardly-opening circlip groove 61 encircles a forward end of the boss 41 whereby the tool 31 is compatible with attachments designed for this mode of attachment, e.g. attachments which do not include the ring 53. Likewise, it remains possible to attach attachments with the aid of a grub screw passing at least approximately radially through the serpentine-engaging portion 51 of the attachment.

What is claimed is:

1. A device, for rotationally driving an element, including a rotationally-driven member, rotatable about a rotation axis of the device, at a front of the device and engageable with, to transmit rotational drive to, the element;

an anti-rotation formation comprising an exterior shaped to contact, to transmit a reaction torque to, an attachment to the device to stop the device from rotating about the rotation axis, the attachment comprising a reaction arm;

an anchor point behind the anti-rotation formation; and a collar comprising a flange, the collar being threadingly engageable with the attachment and rotatable to act between the anchor point and the attachment to rearwardly urge the attachment by engagement of the flange with the anchor point, wherein the rotationally driven member projects from the anti-rotation formation.

2. The device of claim 1 wherein the anchor comprises a rib formation running about the device.

3. The device of claim 2, wherein the rib formation is positioned to radially reinforce a housing to resist deformation resultant from action of a gear mechanism carried with the housing.

4. The device of claim 1 being a gearbox.

5. The device of claim 1 being a tool including a motor.

6. A set including the device of claim 1 and the attachment.

7. The device of claim 1 further comprising a resilient element positioned to enable the collar to be securely and reliably hand-tightened.

8. The device of claim 7, wherein the resilient element comprises an O-ring.

9. The device of claim 1 further comprising an outwardly opening circlip groove in front of the anti-rotation formation for retaining another attachment.

10. The device of claim 1, wherein the anti-rotation formation is a tubular boss.

* * * * *